US009322589B2

(12) United States Patent
Micic et al.

(10) Patent No.: US 9,322,589 B2
(45) Date of Patent: Apr. 26, 2016

(54) UNIFIED FREEZER CHAMBER VENTING WITH DOOR HANDLE

(71) Applicant: Eppendorf AG, Hamburg (DE)

(72) Inventors: Goran Micic, Rainham (GB); Simon Clark, Colchester (GB); Elliot Rothberg, Westborough, MA (US)

(73) Assignee: Eppendorf AG, Hamburg (DE)

( * ) Notice: Subject to any disclaimer, the term of this patent is extended or adjusted under 35 U.S.C. 154(b) by 360 days.

(21) Appl. No.: 13/938,151

(22) Filed: Jul. 9, 2013

(65) Prior Publication Data

US 2015/0013352 A1 Jan. 15, 2015

(51) Int. Cl.

| | |
|---|---|
| ***F25D 17/04*** | (2006.01) |
| ***E06B 7/02*** | (2006.01) |
| ***F25D 23/02*** | (2006.01) |
| ***E05B 65/00*** | (2006.01) |
| ***E05C 3/10*** | (2006.01) |

(52) U.S. Cl.

CPC ..... *F25D 23/028* (2013.01); *E05B 65/0042* (2013.01); *E05C 3/10* (2013.01); *F25D 17/047* (2013.01); *Y10T 29/49826* (2015.01)

(58) Field of Classification Search

CPC ..... F25D 17/047
USPC ..... 454/195
See application file for complete search history.

(56) References Cited

U.S. PATENT DOCUMENTS

| | | | | |
|---|---|---|---|---|
| 2,116,813 | A * | 5/1938 | O'N Weisser | A23B 4/066 292/DIG. 71 |
| 5,573,323 | A * | 11/1996 | Kim | F25D 17/047 312/405 |
| 5,906,423 | A * | 5/1999 | Lyu | F25D 17/047 220/231 |
| 5,988,709 | A * | 11/1999 | Lee | E05B 65/0042 292/199 |
| 6,796,921 | B1 * | 9/2004 | Buck | B25F 5/001 173/47 |
| 8,099,974 | B2 * | 1/2012 | Diebold | F25D 17/047 62/410 |
| 2005/0081555 | A1 * | 4/2005 | Seiss | F25D 17/047 62/410 |
| 2005/0160754 | A1 | 7/2005 | Hugh et al. | |
| 2006/0021284 | A1 * | 2/2006 | Benz | F25D 17/047 49/477.1 |
| 2010/0307189 | A1 * | 12/2010 | Keller | F25D 17/047 62/449 |
| 2012/0031142 | A1 * | 2/2012 | Marton | A61F 7/10 62/530 |
| 2012/0103992 | A1 * | 5/2012 | Takahashi | F25D 17/047 220/288 |

* cited by examiner

*Primary Examiner* — Frantz Jules
*Assistant Examiner* — Erik Mendoza-Wilkenfel
(74) *Attorney, Agent, or Firm* — Arnold & Porter LLP; Todd A. Lorenz

(57) ABSTRACT

The present invention relates to a freezer and method for fabricating a freezer.

17 Claims, 5 Drawing Sheets

UNIFIED FREEZER CHAMBER VENTING WITH DOOR HANDLE

Figure 1:
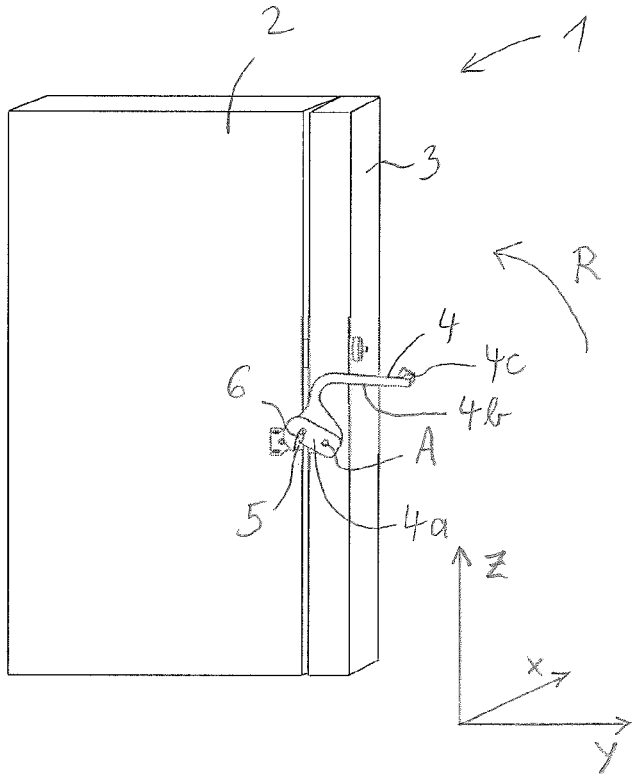

The invention relates to a freezer, in particular for providing ultra low temperatures, and to a method for manufacturing the freezer.

Said freezer are used, for example, in chemical, biological, biochemical, medical and forensic laboratories for storing laboratory samples, in particular solid, gel-like, and liquid samples, at low temperatures, in particular ultra low temperatures. Low temperatures are considered to range between 0° C. and −50° C., while ultra low temperatures range between −50° C. to −90° C. Under such conditions, laboratory samples based on an aqueous solution and many other liquid samples will freeze. Freezers typically are upright freezers, which are placed on the floor or a desktop. The freezers have an inner volume for storing the samples, and a casing is provided for encasing the inner volume. The encasing includes a door, which often is a front door hinged to a side edge of the casing. The cooling can be achieved by cold inner walls, which contact the inner volume. The cooling is achieved by conduction of heat from the air inside the inner volume to the cold inner walls, which is supported by the convection of the air. Evaporation or cooling tubes of a refrigeration system can be provided to cool the walls, which can be connected to an (ultra) low temperature refrigeration unit arranged, for example, below the inner volume of the freezer.

A problem related to such freezers is that when the front door is opened, warm, humid air will enter the inner volume of the freezer. The warm air quickly replaces the cold air inside the inner volume, because the cold air has a higher density than the warmer air and will flow out from the inner volume, driven by gravity and turbulence. After the door is closed again, the humidity inside the inner volume will quickly condense at the inner walls of the freezer. Thereby, the pressure inside the inner volume is reduced and a vacuum condition is being formed. Furthermore, the cooling process then leads to a further drop of pressure due to reduction in temperature of warm air leading to volume reduction. As a negative consequence, the subsequent opening of the door is hindered by the vacuum.

Therefore, freezers can be provided with a ventilation channel, which can be manually opened by a user, prior to opening the door, in order to equilibrate the pressure levels of the inner volume of the freezer and of the surrounding atmosphere. However, such an additional manual operation would be uncomfortable. Moreover, the ventilation channel can become blocked after closing the door by the formation of ice, which results from the humidity in the air. As a consequence, the ventilation channel cannot fulfill its purpose.

US 2005/0160754 A1 discloses a solution for the aforementioned problem, wherein the formation of ice, which blocks the ventilation channel, is described to be prevented by a heating device, which is arranged to permanently heat the ventilation channel during operation of the freezer. However, it was observed for such a solution that the formation of an ice layer cannot completely be prevented and ice is formed outside at the edge of the ventilation channel.

It is the object of the present invention to provide an improved freezer, which can be comfortably operated, and whereby the function of the ventilation channel is preserved, and to provide a method for manufacturing the freezer.

The object is met by the freezer according to claim 1 and the method according to claim 18.

According to the invention a freezer, in particular for providing ultra low temperatures, has: a casing device, which encases the inner volume of the freezer and which has a door member, which, in a closed position of the door member, closes the inner volume and which, in an opened position, allows for accessing the inner volume, a ventilation device, which is configured to at least temporarily connect the inner volume with the surroundings of the casing by a vent channel, which may become blocked by frozen material, a breaker element, which is movably arranged at the vent channel to break the frozen material by a breaking movement, when the breaker element is moved from a first breaker position, where the frozen material may block the vent channel, to a second breaker position, where the frozen material may be removed from/around the vent channel by the breaker element to unblock the vent channel, a handle device for closing and opening the door member using a handle movement, also referred to as "first handle movement", wherein the freezer is configured to effect said breaking movement by an operation of the handle device.

An advantage of the invention is that the ice layer will be removed automatically, when the user operates the handle member; removal of the frozen material, which blocks the ventilation channel, is effected in a one-step process with the handle operation. This way, the operation of the freezer is comfortable and the work flow is more efficient. The conditions of venting the inner volume of the freezer are unitized, leading to reproducible and constant storage conditions for the samples.

Preferably, the handle device has a handle member, which is movably arranged at the door element and can effect said breaking movement by the handle movement, which transfers the handle member at least from a first handle position to a second handle position. This way, it is possible to manual provide the mechanical energy, which is necessary to provide the breaking movement.

However, it is also possible that the breaking movement is driven by an automated drive device, in particular by an electrical actuator. It is further preferred that the operation of the handle device triggers the breaking movement, for example by using, e.g., a sensor device of the freezer, which detects the operation of the handle device. Such a sensor device could be, for example, a capacitive sensor, which can be part of the handle device.

The freezer according to the invention can have more than one inner volume, more than one casing device, more than one handle device, more than one handle member, more than one breaker element, more than one ventilation device, more than one vent channel, which can be combined, respectively, according to the teachings of the description of the present invention and the preferred embodiments.

The freezer can have at least one door member, which can be a front door. The freezer preferably has a substantially cuboid-shaped inner volume, which is limited by inner walls of the freezer. The inner volume of the freezer can be divided in at least two or more inner compartment. The compartments can be arranged as levels on top of each other and/or by an arrangement of compartments side by side. Compartments allow to separate samples from each other, which can be desirable in a laboratory, where a variety of different samples have to be cooled. The freezer can have at least one inner door member, which may be arranged to open/close at least one compartment. The separation of at least two compartments can be achieved by arranging at least one inner wall between the at least two compartments, for example in a vertical and/or horizontal alignment. The at least one inner wall preferably is not configured to have thermally insulating properties. The at least one inner door member, preferably, has thermally insulating properties.

However, it is possible and preferred to provide an inner volume, where the compartments are thermally insulated from each other. This allows to provide different storage temperatures in one freezer.

The freezer can have more than one inner volume. At least two inner volumes can be thermally insulated from each other, for providing at least two inner volumes with separated storage conditions, in particular, with different storage temperatures.

The casing device of the freezer is configured to thermally insulate the inner volume of the freezer from the surrounding atmosphere, in particular to provide thermal insulation for providing low temperatures and ultra low temperatures within the at least one inner volume.

In the context of the description of the present invention, low temperatures are considered to range between 0° C. and −50° C., while ultra low temperatures range between −50° C. to −90° C.

The freezer preferably has a refrigeration system, which preferably has an electrical control device and a cooling system, and preferably at least one temperature sensor. The control device can be configured to control the temperature within at least one inner volume of the freezer, in particular by measuring the inner temperature inside the inner volume and achieving the adjustment of the inner temperature by controlling a cooling system. The control device can use control loops for controlling the temperature. The cooling system can have a fluid transport system for transporting a refrigerant fluid, e.g. carbon dioxide or other hydrocarbons. Tubes of the fluid transport system can be in thermal contact with inner walls of the freezer, for allowing the heat exchange. The refrigerant fluid is controlled to have a required target temperature, which leads to the nominal temperature inside the inner volume. Adjustment of the target temperature is achieved by electrically controlling a temperature control device, which can be any known refrigerating machine.

The breaker element can have or consist of a pin member, which is configured to perform a breaking movement. The pin member preferably is arranged to perform a translational breaking movement, wherein the direction of the breaking movement preferably is perpendicular, or is arranged in an angle different from Null, to the inner side of a wall of the casing device, which preferably also carries the at least one ventilation channel. The breaker element preferably is driven manually, in particular mechanically, by the driving force of the handle movement, but can also be driven by machine, in particular by an electrical actuator. The breaker element can be the stem piece of a valve, in particular. The breaker element is preferably spring supported at the vent channel.

The breaking movement preferably is a translational movement. This allows for an efficient realization of a breaker element, which can be a pin member. However, the breaking movement can also be a rotational movement and/or a combined translational and rotational movement.

The handle device and, respectively, the handle member is, preferably, manually operated and, preferably, driven by the user to perform the handle movement. The handle movement preferably is a rotational movement. This allows for a comfortable closing and/or locking of the door member. However, the handle movement can also be a rotational movement and/or a combined translational and rotational movement. The handle movement preferably is performed when the user closes and/or locks the door member. This has the advantage that the vacuum is immediately starting to be vented after it has formed inside the inner volume. Samples stored inside the inner volume are then not (or less) affected by the vacuum. It is also possible and preferred to, alternatively or additionally, effect the breaking movement when the user opens and/or unlocks the door member. This way, any residual vacuum can be removed. The handle movement can include a second handle movement, for transferring the handle member from a second position into the third position. The second handle movement can also be a separate movement, which is performed, preferably, after the first handle movement.

The handle member can be a single-part piece. Preferably, the handle member is a two-part piece, which has two separate pieces, which are connected to be movable relative to each other. This allows for additional functionality, which is described below. The handle member can be a multi-part piece, which has more than two separate pieces, preferably three pieces, which can be, or not, connected to be movable relative to each other.

The ventilation device serves to at least temporarily vent at least one inner volume of the freezer. The ventilation device can have at least one vent channel, to at least temporarily connect the inner volume with the surroundings of the casing. The vent channel preferably is configured to contain the breaker element, and preferably is configured to guide the breaker element. For example, in case that the vent channel is substantially a hollow cylinder shaped section or recess in a wall of the casing, in particular in the door member, and the breaker element is a pin member, i.e. an at least in part pin-shaped member, the pin member can be guided to perform a translational movement inside the vent channel. The pin member can be the stem of a valve. The ventilation device can have more than one vent channel. A vent channel preferably is part of a valve, which preferably is configured to close the vent channel, when the pressure inside the inner volume is larger than the pressure in the surrounding atmosphere. The valve can have a plug piece, e.g. a plug membrane, which closes the open cross section of the vent channel upon a pressure difference between the inner and outer pressure. An actuator can be provided to control the position of the plug piece. The actuator can be controlled electrically. However, preferably the actuator is actuated mechanically, by the driving force of the handle movement. The plug piece or the stem, which preferably is connected to the plug piece, can be spring supported at the vent channel. Preferably, the valve is formed as a disc valve.

The vent channel can be formed along a straight line and can extend through a side wall of the encasing of the freezer, in particular through a door member of the freezer. The vent channel may be oriented perpendicular or in an angle different from 90°, with respect to a side wall or door member of the freezer. Alternatively, the vent channel may be formed along a curved path, if required.

Preferably, the ventilation device is formed as a valve, which is configured to block the vent channel in the first valve position and to open the vent channel in a second valve position, wherein said handle movement preferably transfers the valve from the first valve position to the second valve position. Thereby, the valve can be automatically opened and/or closed when the users performs the handle movement. The valve can be closed, in particular, if there is absence of pressure differential between the inner volume of the freezer and the surrounding.

Preferably, the handle device is configured such that the handle member actuates the breaker element to drive the breaking movement, and the breaking movement is preferably accomplished when the handle member reaches the second handle position. This way, a comfortable and efficient way of breaking the layer of frozen material is provided.

It is also possible and preferred to provide an electrically driven breaker element, which is actuated under electronical control of at least one sensor, which detects the handle positions, whereby an electrical control device controls the actuation of the electrically driven breaker element in dependence on the sensor information.

Preferably, the handle device is configured such that the breaking movement is accomplished in the second handle position and the handle movement is continued after the second handle position to a third handle position, where the handle movement is accomplished. Providing such an extended handle movement allows to more flexible control the breaker element. In case of a mechanically driven breaker element, the third handle position can be used to effect the closing of the vent channel after the temporary opening of the vent channel. This is useful, because the vent channel should be closed during the main time periods of operation of the freezer.

Preferably, the freezer has a locking device, which can have a locked position, where the door member is closed and locked, and which can have an unlocked position, where the door member is closed and unlocked. The locking device is configured to safely hold the door member in the closed position. The locking device preferably has a first locking section, which is arranged at the handle member, and a second locking section, which is arranged at the casing device, wherein preferably the first locking section and the second locking section are configured to fully engage in the locking position. The first locking section preferably comprises (or is) a slot formed in the handle member. The second locking section preferably comprises a bar member or a pin member etc. The slot can have an open end and a closed end, wherein a pin member can enter the slot at the open end. The second locking section preferably comprises (or is) a pin member configured to fit in the slot. Preferably, the slot is curve-shaped, wherein the curve is preferably excentric with reference to the pivot axis of the handle member, or respectively, a first part of the handle member. This way, a positive guiding of the door member with respect to the casing device can be achieved during the locking of the locking device. The door member can be pushed—preferably against the pressure resulting from compression of an elastic sealing—towards the casing device of the freezer when the locking device is locked. During the locking, in particular, the first locking section and the second locking section engage; for example, the pin member moves from an open end of the slot to a closed end of the slot, where the pin is stopped to move and the locking position is reached.

Preferably, an elastic sealing is provided between the door member and the casing for sealing the inner volume in the closed position of the door member. The locking of the locking device preferably compresses the elastic sealing, thereby increasing the sealing effect. In the second handle position, the locking device is preferably fully locked and the sealing effect is maximized.

Preferably, in the first handle position, the valve is in the first valve position and, in the second handle position, the locking device is in the locking position and the valve is in the second valve position. This means that the valve is open in the second handle position, when the door member is in a predefined locked position. Thereby the venting of the inner volume takes place by using the valve, and in particular not any residual gap between the door member and the rest of the casing device.

Preferably, in the first handle position, the locking device has not yet reached the locking position. This way, the handle movement can be continued while the locking continues and, preferably while the opening of the vent channel continues in a controlled way.

Preferably, in the third handle position, the locking device is in the locking position and the valve is in the first valve position. This way, the third position is realized to be the storage position of the handle member and the freezer, where the door and the vent channel are locked and therefor the inner volume is separated from the surrounding atmosphere. The second handle movement between the second handle position and the third handle position is preferably driven by the tension of a spring member, which is automatically elastically tensioned, when the handle member is moved into the second handle position. The spring member can also be tensioned in the first and third handle position, but preferably to a lesser extent than in the second handle position. This effects that the second handle movement is automatically performed by the elastic force of the spring member, when the user unhands the handle member.

In a preferred embodiment of the handle member and the freezer, respectively, the handle member has at least one, preferably one, first part and at least one, preferably one, second part, which are arranged movably, preferably rotatable, with respect to each other. This allows the breaking movement to be performed while the door member is locked (i.e. the handle member is in the second handle position), because the first part of the handle member, which preferably carries a first locking section, can be locked while the second part is still movable in order to perform the breaking movement. Providing a first part and a second part allows to realize the second handle position to be a first relative position of the first part and the second part and allows the third handle position to be a second relative position of the first part and the second part. The first part, preferably, is not moved, while the door member is locked, and the second part can be moved in relation to the first part, for performing the breaking movement. Preferably, the freezer, and/or, respectively, the handle member, is configured such that the breaking movement is performed in dependence of the handle movement, in particular such that the user automatically performs the breaking movement, when he performs the first handle movement, e.g. by pushing the handle member from the first handle position (i.e. the door member is open) to the second handle position (i.e. the door member is closed). As an alternative or in addition, it is also possible and preferred, that the breaking movement may be performed independently from the first handle movement.

Preferably, the handle member has a first part and a second part, which are pivotably connected to each other, e.g. directly or by using a third part, which forms a pivot point, to perform a pivoting movement between a first angle position and a second angle position, wherein, in the first angle position, the handle member is in the second handle position and, in the second angle position, the at least one handle member is in the third handle position. This way, the locking device can be in the locked position, while the second part performs a second handle movement, wherein the second part continues to move from the position of the second part in the second handle position to the position of the second part in the third handle position, whereby the first part preferably contains or carries the first locking section. The second handle movement thereby closes the vent channel such that the third handle position is the storage position of the freezer, where the freezer is locked and fully insulated from the surrounding atmosphere.

Preferably, the door member has an outer side, which faces away from the inner volume in the closed door position, and an inner side, opposite to the outer side, and a first lateral side and a second lateral side, which are opposite to each other, and a top side and a bottom side, which are opposite to each other, wherein the door member is pivotably attached to the freezer at the first lateral side, and the handle member is pivotably connected at the second lateral side. This allows for an efficient configuration of the handle member.

Preferably, the door member is pivotably connected at the freezer to pivot around the z-axis of a Cartesian coordinate system, wherein the handle member is pivotably connected to the door member to pivot, preferably, around the x-axis of the Cartesian coordinate system, which x-axis, preferably, runs in parallel to the top side and/or bottom side of the door member, in the closed position of the door member, and which x-axis is perpendicular to the z-axis. This way, an intuitional operation of the handle member is possible.

Preferably, the handle member has a first part and a second part, which are movably arranged to one another, wherein the first part is pivotably connected to the door member to pivot around the x-axis of the Cartesian coordinate system. This way, the handle movement can be a rotational movement. The handle movement, which moves the first part of the handle member around the x-axis, can be continued by the relative (rotational) second handle movement of the second part in relation to the first part, using as rotational axis the x-axis or an axis parallel to the x-axis. The second handle movement can be driven by the elastic force of a spring member.

Preferably, the first part extends parallel to the y-z-plane of the Cartesian coordinate system, wherein the second part has a first section and a second section, wherein the first section at least in part extends parallel to the y-z-plane and, the second section, opposes at least in part the door member and at least in part extends parallel to the x-z-plane. The second section of the second part of the handle member can be configured to be the gripping section, where the user grips the handle member for performing the handle movement.

Preferably, the handle device has a spring member, which is elastically tensioned by the handle movement, when the handle member is moved into the second handle position. The elastic force of the spring member can drive the second handle movement, which brings the handle member and the freezer into the storage position.

Preferably the breaker element is formed as a pin member, which extends through the vent channel, and which has a first end for breaking the frozen material, wherein, in the second breaker position, the first end is arranged more inside the inner volume than in the first breaker position. This way, a layer of frozen material, which has formed at the opening of the vent channel at the inner side of the vent channel, is broken and removed, and the vent channel is opened.

Preferably, the handle member has a contacting area for contacting the second end of the pin member and for pressing the pin member from the first breaker position, which may correspond to the first handle position, into the second breaker position, which may correspond to the second handle position.

The breaker element, respectively the pin member, can also be pressed by using a contact area, which is configured to be a sliding area, wherein the sliding surface slides along the contact end of the breaker element during the handle movement and/or the second handle movement. The sliding surface can have at least one ramp area and/or at least one curvature area: the handle mechanism can be configured such that at least one ramp area and/or at least one curvature area of the sliding surface changes the distance of displacement of the breaker element, in particular starting from the first breaker position. The distance of displacement corresponds to any breaker position between the first breaker position and the second breaker position, in particular. The distance is automatically changed during the handle movement and/or the second handle movement. Preferably, the sliding surface is formed to actuate the breaker element during the handle movement, i.e. between the first handle position and the second handle position, and to release—in particular in case of a spring supported breaker element—the breaker element during the second handle movement, i.e. between the second handle position and the third handle position. The movement of the of the breaker element can also be positive guided by a slot-pin mechanism, where a slot member with at least one ramp section and/or at least one curvature section forces a pin to move in the slot member, thereby changing the position of the pin relative to the slot member. The pin of the slot-pin mechanism can be connected to the breaker element and the slot member can be connected to the handle member, or vice versa.

In particular in the case of a sliding surface, the handle device can be configured such that the handle movement is continuously transferred into the second handle movement, by providing a first sliding area along the sliding surface, which corresponds to the handle movement, and a second sliding area along the sliding surface, which corresponds to the second handle movement. Using such an efficient configuration, the user can drive the handle member from the first handle position to the third handle position (storage position) by a continuous movement.

Preferably, the handle member has a security lock for securing the locked position of the door member, where the door member is closed and locked by a locking device. Preferably, the security lock is configured for securing the handle member, in particular the first part of the handle member. The secured position of the handle member is referred to as the secured handle position. The secured handle position, can be, in particular, the second or the third handle position, wherein preferably the security lock can be locked by a key. The security lock is different from the locking device, but can be configured to interact with the locking device, in particular by letting a movable pin member of the security lock engage an opening in the location of the pivot point of the handle member or in a pin member of the locking device.

In the first preferred embodiment of the handle member and the freezer, respectively, the handle member has at least one, preferably one, first part and at least one, preferably one, second part, which are arranged movably, preferably rotatable, with respect to each other. This allows the breaking movement to be performed while the door member is locked. Said goal, however, can also be achieved by other preferred embodiments of the handle member and the freezer, respectively:

In a second preferred embodiment of the handle member and the freezer, respectively, the freezer has a device for positive guide and, preferably, the handle member comprises—or substantially consists of—one part, in particular a single piece part, which interacts with the breaker element by means of a device for positive guide. This allows, in particular, the breaking movement to be performed while the door member is locked. The device for positive guide is preferably configured such that different positions of the breaker element and/or the locking device are set by preferably one handle movement, which preferably is a continuous handle movement. Depending on the relative position of the handle member during the handle movement, the device for positive guide defines a corresponding position of the breaker element and/or the locking device. Using a device for positive guide allows for an intuitive operation of the freezer, which in particular automatically removes any ice layer around/from the vent channel during the handle movement.

The device for positive guide is preferably configured such that in a first guide position, the breaker element may be not actuated when the handle member is in the first handle position. In the preferred embodiments, where the vent channel is formed by a valve, in the first guide position, the valve may be in the first valve position (i.e. the valve closed).

In a second guide position, the breaker element may be actuated (i.e. the vent channel is unblocked and preferably, the valve forming the vent channel may be transferred from the first valve position to the second valve position, where the valve will be open) when the handle member is transferred from the first handle position (i.e. the door member may be open) to the second handle position (i.e. the door member may be closed and locked).

In a third guide position, the breaker element may be released (e.g. the breaker element is retracted from the position where it has removed an ice layer around/from the vent channel and preferably, the valve forming the vent channel may be transferred from the second valve position to the first valve position, where the valve is closed again), when the handle member is transferred from the second handle position to the third handle position (i.e. the door member may be closed and locked).

In a fourth guide position, the breaker element may be not actuated (e.g. the breaker element is in the retracted position and preferably, the valve forming the vent channel may be in the first valve position, where the valve is closed) and the door member is closed and locked. The fourth guide position may correspond to the storage position of the freezer.

Preferably, the device for positive guide has a curved member, which has a curved section. The curved member, preferably, is the part of the handle member, which interacts with the breaker element during the breaking movement. The curved section can be a curved slot of the curved member or a curved outer shape, e.g. a curved side wall or a curved plate element of the curved member. The curved element can be an excentric element. The curved member may be part of the handle member or which may be coupled to the handle member. The handle movement, which may be a rotation, can effect a relative motion of the breaker element and the curved section of the curved member.

The freezer, which has a device for positive guide, preferably has a mechanism, which automatically operates the unlocking device during the handle movement. For example, the mechanism can be configured such that a first locking section of the locking device, which is part of the handle member, is actuated by the mechanism to engage a first locking section of the locking device, such that the locking device and the door member are unlocked in the first handle position and are locked in the second handle position. The mechanism can comprise an arrangement of at least one rod and/or at least one axle and/or at least one lever and/or at least one pawl and/or at least one gear rack and/or at least one gear-wheel and/or at least one excentric, and/or other mechanical parts.

The invention is further related to a method of the manufacture of a freezer according to one of the previous claims, wherein, preferably, the handle member comprises at least a first part and at least a second part, wherein, preferably, the handle member, in particular the first part and the second part, is/are at least in part composed of one material or of at least one material. The material, preferably, is a glass filled plastic, preferably a fiber reinforced material, in particular a glass fiber reinforced plastic. Moreover, the material can be moulded from metals or machined from solid material blocks.

Further preferred embodiments of the method according to the invention of manufacturing a freezer can be derived from the description of the preferred embodiments of the freezer.

Further preferred embodiments of the freezer according to the invention and the method according to the invention can be derived from the following description of preferred embodiments of the invention:

FIG. 1 shows a perspective side view of a preferred embodiment of the freezer according to the invention.

Figure 2A:
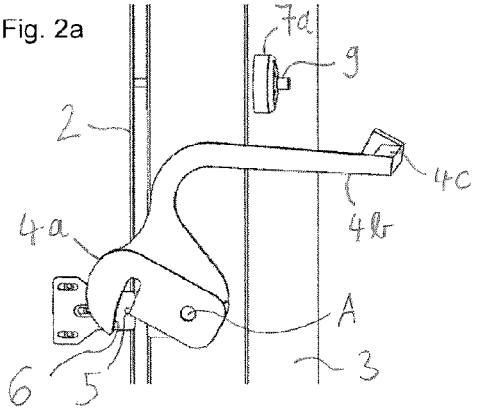

FIG. 2*a* shows a detail of the freezer with the handle device as shown in FIG. 1, in a position of the handle member, where the handle member approaches the first handle position.

Figure 2D:
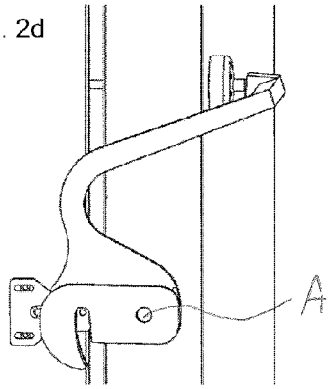
Figure 2B:
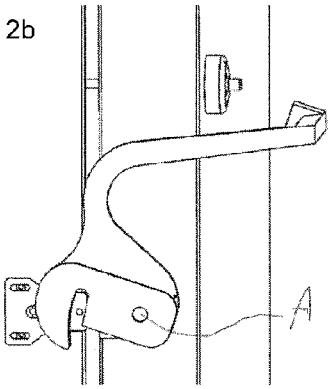

FIG. 2*b* shows the detail of FIG. 2*a*, in a position of the handle member, where the handle member is closer at the first handle position than in FIG. 2*a*.

Figure 2E:
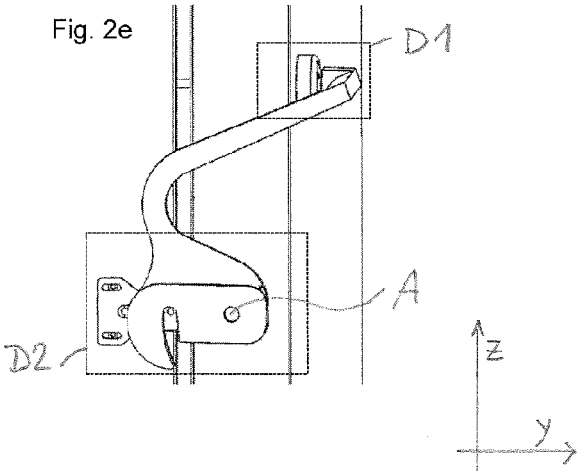
Figure 2C:
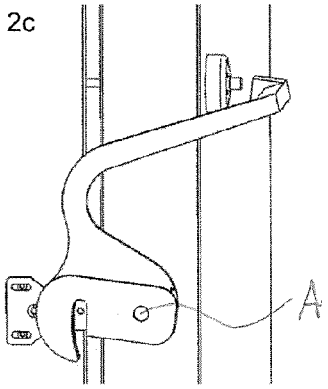

FIG. 2*c* shows the detail of FIG. 2*b*, in a position of the handle member, where the handle member is closer at the first handle position than in FIG. 2*b*.

FIG. 2*d* shows the detail of FIGS. 2*a*, 2*b* and 2*c*, where the handle member has reached the first handle position.

FIG. 2*e* shows the detail of FIGS. 2*a*, 2*b*, 2*c* and 2*d*, where the handle member has reached the second handle position.

Figure 2F:
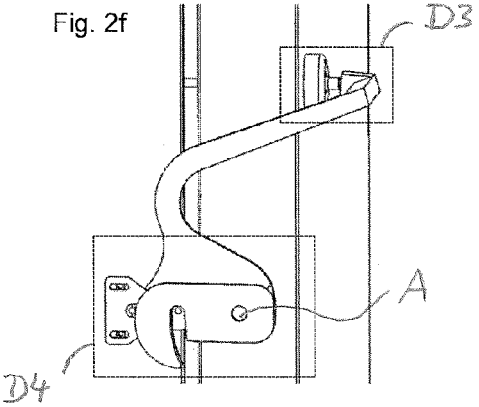

FIG. 2*f* shows the detail of FIGS. 2*a*, 2*b*, 2*c*, 2*d* and 2*e*, where the handle member was released and has reached the third handle position.

Figure 3A:
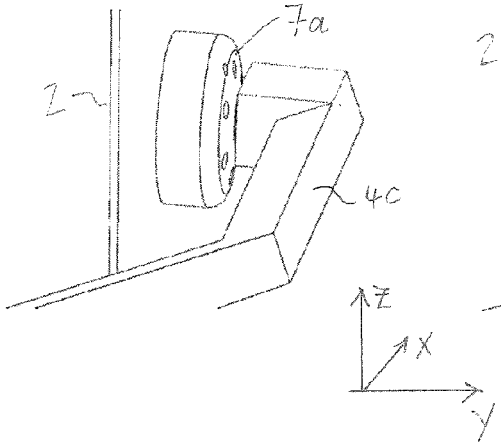

FIG. 3*a* shows the detail D1 from FIG. 2*e*.

Figure 3B:
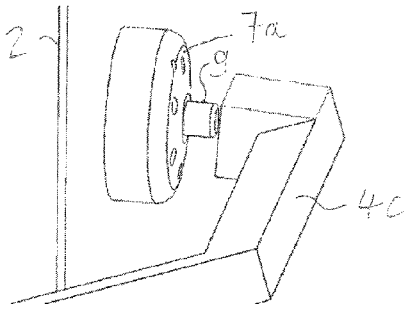

FIG. 3*b* shows the detail D3 from FIG. 2*f*.

Figure 4A:
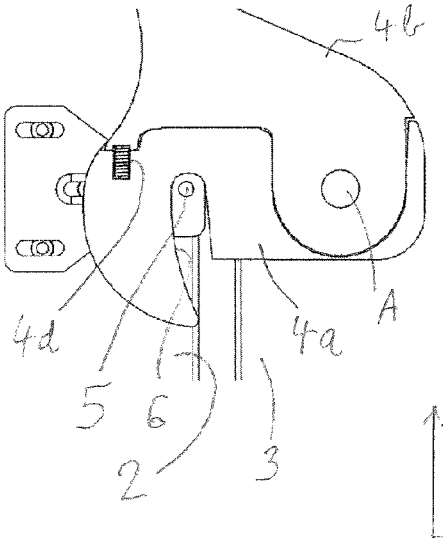

FIG. 4*a* shows the detail D2 from FIG. 2*e*.

Figure 4B:
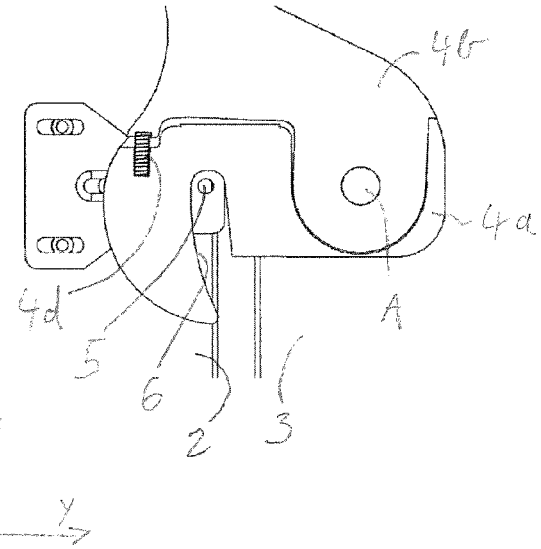

FIG. 4*b* shows the detail D4 from FIG. 2*f*.

Figure 5A:
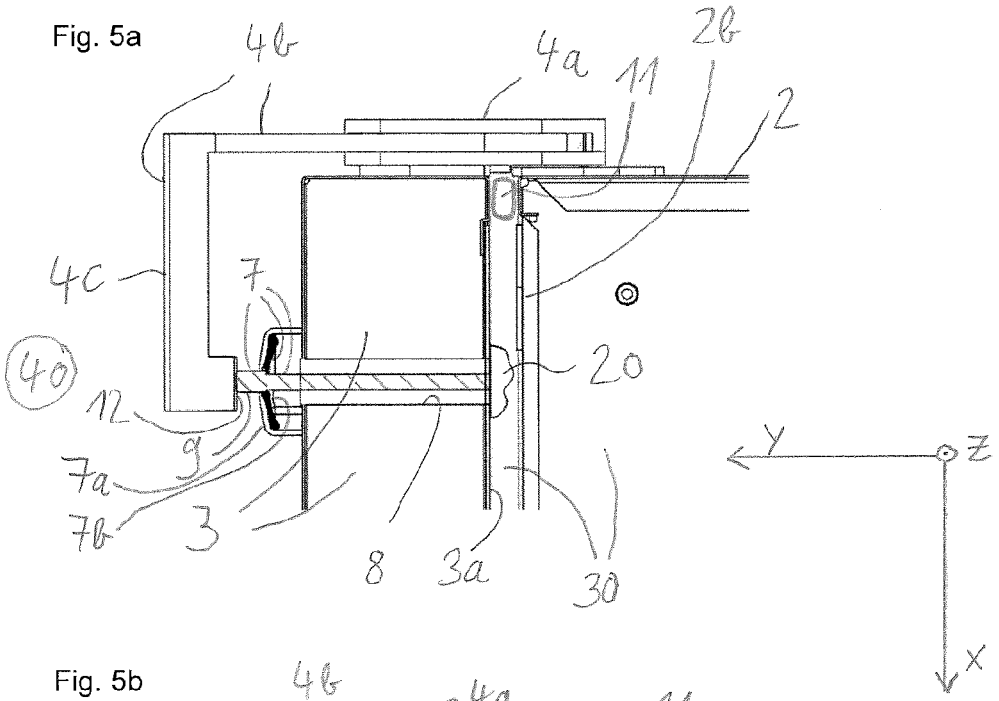

FIG. 5*a* shows a detail of the freezer in FIG. 1, in particular shows the handle member in a top view, wherein the door member, the casing device and the ventilation channel are shown as a cross section parallel to the x-y-plane, wherein the first handle position, the first valve position and the first breaker position are shown and the frozen material blocks the vent channel.

Figure 5B:
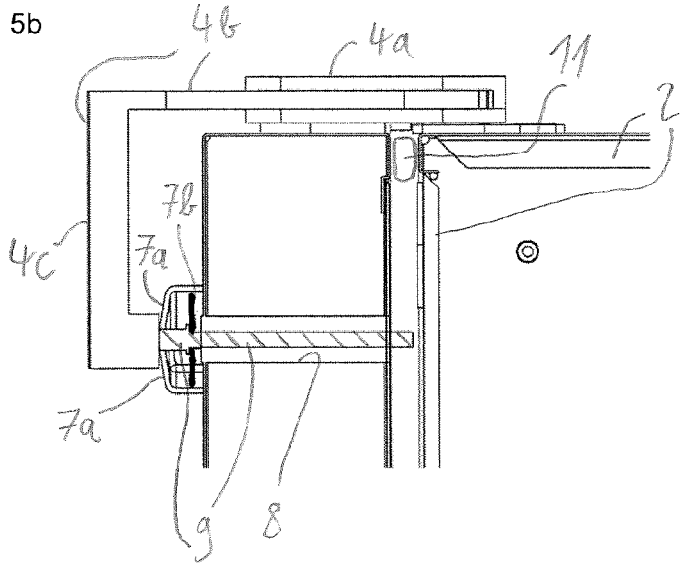

FIG. 5*b* shows the detail of FIG. 5*a*, wherein the second handle position, the second valve position and the second breaker position are shown and the frozen material was broken and removed from the vent channel.

Figure 6A:
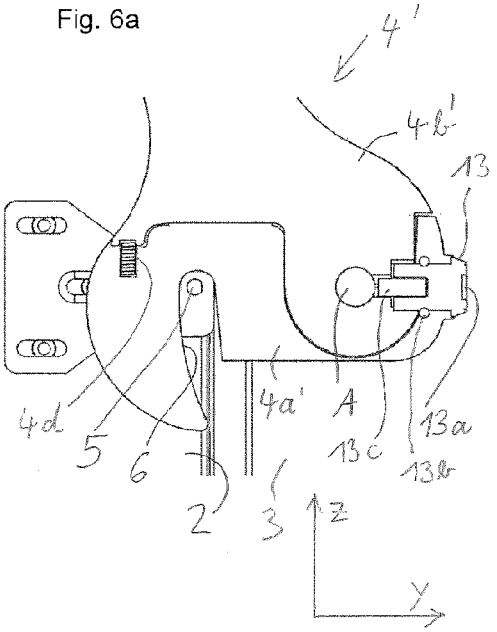

FIG. 6*a* is a detail corresponding to the view in FIG. 4*a*, of a further preferred embodiment of the freezer, in the second handle position, wherein the handle member has a securing lock, which is shown in its unlocked position.

Figure 6B:
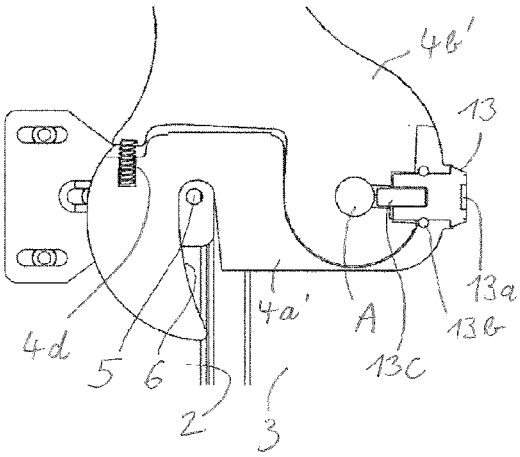

FIG. 6*b* is a detail corresponding to the view in FIG. 4*a*, of the embodiment of the FIG. 6*a*, in the third handle position, wherein the handle member has a securing lock, which is shown in its unlocked position.

Figure 7A:
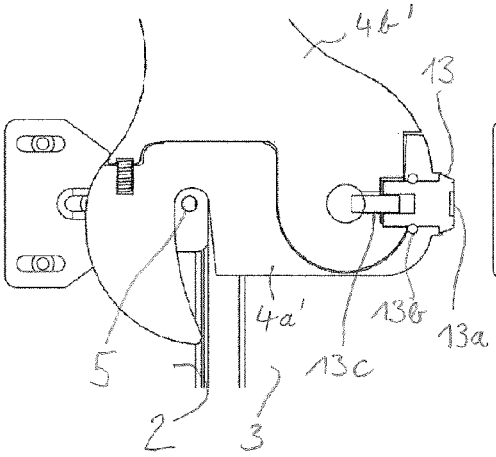

FIG. 7*a* is a detail corresponding to the view in FIG. 4*a*, of a further preferred embodiment of the freezer, in the second handle position, wherein the handle member has a securing lock, which is shown in its locked position.

Figure 7B:
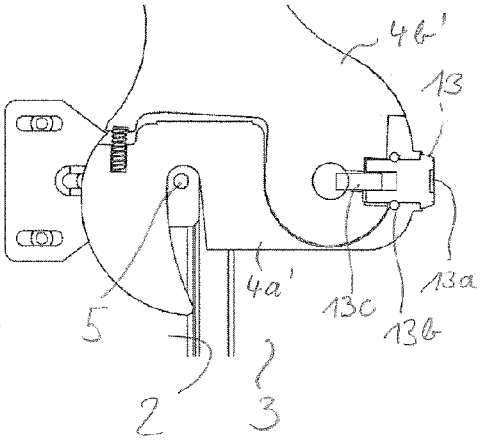

FIG. 7*b* is a detail corresponding to the view in FIG. 4*a*, of the embodiment of the FIG. 7*a*, in the third handle position, wherein the handle member has a securing lock, which is shown in its locked position.

FIG. 1 shows a laboratory freezer 1 for storing laboratory samples at ultra low temperatures. The freezer is an upright freezer with a casing device 2, which is a substantially cuboid shaped housing, which encases the inner volume of the freezer. The casing device 2 also encases the refrigeration device of the freezer and the electrical control device (not shown), located mainly in the bottom part of the freezer, below the inner volume. The casing device 2 has a front door member 3, which is pivotable connected to an edge of a side wall of the casing device 2. The door member 3 is rotatable around a vertical axis, which is in parallel to the z-axis of the Cartesian coordinate system. The freezer 1 has a handle device, which includes the handle member 4. The handle member 4 is rotatably mounted to a side wall of the door member 3, which side wall is in parallel to the y-z-plane, when the door member is closed. The handle member is allowed to rotate around axis A, which is in parallel to the x-axis. The pivot shaft (A), which includes the axis A, forms the pivot point of the first part 4*a* and the second part 4*b*, which are pivotably connected to each other via the pivot shaft. The pivot shaft is firmly connected to the door member 3, here, in particular, to a side wall of the door member 3.

In FIG. 1, the door member is slightly opened, because the locking device is not locked in the locking position yet. The locking device has a first locking section, namely the slot 6, arranged at the handle member 4, and the pin member 5. The slot 6 is provided at the first part 4*a* of the handle member. The second part 4*b* is mounted movable at the first part 4*b*, such that the second part 4*b* can be slightly be rotated against the first part 4*a* around the axis A, in particular to perform the "second handle movement", which transfers the handle member from the second handle position to the third handle position, which is the storage position. This will be explained in detail. The second part 4*b* of the handle member has a grip section 4*c*, which can be gripped by the user to operate the handle member.

The user will rotate the handle member along the direction R towards the door member, for locking the locking device and for transferring the handle member in the second position.

FIG. 5*a* shows a detail of freezer 1 in a top view. The casing device 2 has multiple inner door members 2*b*, which close the front opening of several compartments of the inner volume of the freezer 1. The door member 3 is closed and pressed against the sealing 11 by the locking device, which is in the locking position. In the closed position shown, closes the inner volume. In an opened position, allows for accessing the inner volume, in particular for opening the inner door members 2*b*.

The ventilation device is formed as a valve 7 and is configured to temporarily connect the inner volume 30 with the surroundings 40 of the casing 2 by a vent channel 8, which is blocked, in FIG. 5*a*, by frozen material 20. The valve 7 includes at least the valve cap 7*a*, which has openings (not shown), which are facing the gripper section 4*c* of the second part 4*b* of the handle member 4. The valve 7 further includes at least the valve stem 9 and the vent channel 8.

The breaker element is the pin member 9, which also forms the stem of the valve 7, which carries the membrane plug 7*b*, which is movably arranged at the vent channel to break the frozen material by a breaking movement.

In the opened position of the valve, referred to as the first valve position, shown in FIG. 5*b*, the plug membrane 7*b* is removed from the inner side of the front wall of the valve cap 7*a*. Thereby, air is allowed to enter the inner volume of the freezer via the openings of the valve cap 7*a* and the vent channel 8, if there is pressure differential between the inner volume and the surrounding. The openings of the valve cap 7*a* are oriented substantially in parallel to the x-z-plane.

In FIG. 5*a*, the handle member 4 is in the first position and the locking device is not yet fully locked, which means that the locking pin 5 has not yet stopped at the inner side of the closed end of the slot 6 of first part 4*a* of the handle member 4. In FIG. 5*a*, the first handle position, the first valve position and the first breaker position are shown and the frozen material blocks the vent channel.

In FIG. 5*b*, the handle member 4 is in the second handle position. Starting from the first handle position, the handle member 4 was further rotated around axis A, along direction R (see FIG. 1). The contact area 12 of the handle member 4 has contacted the front face of the breaker element 9, and has displaced the breaker element 9 in a direction (parallel to the y-axis) perpendicular to the inner wall 3*a* of the door member 3, by a translational breaker movement, such that in the second handle position, the breaker element 9 was pressed against the layer of ice 20, thereby breaking the ice and freeing the venting channel from ice. In the second handle position, shown in FIG. 5*b*, the membrane is removed from the openings at the front side of the valve cap 7*a*, the second valve position (open) is reached, the second breaker position is reached and the ice is removed, the vent channel is open and the inner volume is vented, if there is pressure differential between inner volume and the surrounding.

The breaker element 9 is spring mounted at the vent channel 8. Releasing the breaker element during the second handle movement will drive the breaker element 9, with the membrane plug 7*b* connected to the same, back to the first valve position, thereby closing the openings of the valve cap 7*a*.

The second handle movement is automatically achieved, when the user releases the handle member 4, because a spring member mounted between the first part 4*a* and the second part 4*b* of the handle member 4, which was tensioned by the handle movement, will provide the elastic force to slightly rotate the second part against the first part, along the negative direction −R. Thereby, the first part stays locked in place, in the locking position of the locking device. This way, a comfortable and safe way of realizing a storage position is achieved, where the inner volume of the freezer is completely insulated, in particular the vent channel being closed, and the door member is locked in position.

FIGS. 2*a* to 2*d* show a sequence, where the handle member 4 (4*a*, 4*b*, 4*c*) is moved by a user towards the first handle position, shown in FIG. 2*d*. The user continues to rotate the handle along direction R and performs the handle movement, which brings the handle member from the first handle position to the second handle position. The second handle position is reached in FIG. 2*e*. Starting from the second handle position, the user releases the handle member 4, and the second part is mounted rotatable at the first part around axis A, to rotate back along the negative direction −R, driven by the elastic force of the spring member 4*d*, which is shown in FIGS. 4*a* and 4*b*.

In FIG. 4*a*, corresponding to the second handle position, the coil spring 4*d* was increasingly compressed by the handle movement of the user. In FIG. 4*b*, the elastic force of the coil spring 4*d* has rotated back the second part 4*b* against the first part 4*a* along the negative direction −R, whereby the first part 4*a* stays in the locking position. The slot 6 is excentric with respect to the axis A, and therefore the pin 5 is clamped in the slot 6, in the locking position, supported by the elastic force of the compressed sealing 11 between the inner side of the door member 3 and the housing 2.

FIG. 6*a* is a detail corresponding to the view in FIG. 4*a*, of a further preferred embodiment of the freezer, in the second handle position, wherein the handle member 4' has a securing lock 13, which is shown in its unlocked (i.e. unsecured) position. FIG. 6*b* shows the handle member 4' with the securing lock 13, which is shown in its unlocked (i.e. unsecured) position. FIG. 7*a* shows the handle member 4' with the securing lock 13, which is shown in its locked (i.e. secured) position. FIG. 7*b* shows the handle member 4' with the securing lock 13, which is shown in its locked (i.e. secured) position. The securing lock 13 is fixed to the first part 4*a*' of the handle member 4' by a ring member 13*b*.

The first part 4*a*' and the second part 4*b*' of the handle member 4' have a recess, respectively located on the front side of the handle member. Beyond that, handle member 4' corresponds to handle member 4 and the embodiment of the freezer shown in FIGS. 6*a*, 6*b*, 7*a* and 7*b* corresponds to the freezer 1.

The FIGS. 6*a*, 6*b*, 7*a* and 7*b* show that the recess, respectively, extend from the front side of the handle member along the y-axis towards the pivot shaft (A) of the first part 4*a*' and the second part 4*b*'. The recess forms a section, which takes up a locking pin 13*c* of the securing lock 13. The pivot shaft also has a recess, which can be engaged by the locking pin 13*c* (which is shown in FIG. 7*a* and FIG. 7*b*), thereby locking (i.e. securing) the securing lock and preventing the handle member from being able to be positioned in the first handle position, where the door member would be able to be opened. The locking pin 13*c* will move along the y-axis to engage the recess of pivot shaft 13*c*, when being actuated by a locking movement, which may be performed by a user by applying a locking key through the keyhole 13*a*. It is shown by the figures throughout FIG. 6*a*, 6*b*, 7*a*, 7*d*, that the presence of the securing lock does not influence the movability of the handle member 4' between the second handle position and the third handle position. This means that in the locked position of the handle member 4', where the pin member 5 fully engages the slot 6, the vent channel may be ventilated and any ice layer may be removed by the breaking movement between the third and the second handle position. However, it would also be possible to design the securing lock and the handle member in a way such that the securing lock, in its locked position, also prevents the movement of a handle member between the second handle position and the third handle position.

In a second embodiment of the handle member not shown, the handle member substantially has one part, which has a device for positive guide of the breaker element. In the second embodiment, there is no need for providing a two-part handle member, because the positions of the breaker element can be defined and automatically performed during one handle movement by a curved member, which is assigned to the device for positive guide, while the operation of the locking device can be automatically performed during the handle movement by a mechanism. All embodiments, however, allow for a comfortable operation of the freezer, in particular by automatically unblocking the vent channel.

The invention claimed is:

1. Freezer (1), in particular for providing ultra low temperatures between −50° C. and −90° C., having a casing device (2), which encases the inner volume (30) of the freezer and which has a door member (3), which, in a closed position of the door member, closes the inner volume and which, in an opened position, allows for accessing the inner volume, a ventilation device (7, 7*a*, 7*b*, 8, 9), which is configured to at least temporarily connect the inner volume with the surroundings (40) of the casing device (2) by a vent channel (8), which may become blocked by frozen material (20), a breaker element (9), which is movably arranged at the vent channel (8) to break the frozen material (20) by a breaking movement, when the breaker element (9) is moved from a first breaker position, where the frozen material may block the vent channel (8), to a second breaker position, whereby the frozen material may be removed by the breaker element to unblock the vent channel, a handle device (4; 4*a*, 4*b*, 4*c*, 4*d*, 6) for closing and opening the door member (3), wherein the freezer is configured to effect said breaking movement by an operation of the handle device, wherein the handle device has a handle member (4; 4*a*, 4*b*, 4*c*, 4*d*), which is movably arranged at the door element and can effect said breaking movement by a handle movement, which transfers the handle member at least from a first handle position to a second handle position, and wherein the ventilation device is formed as a valve (7), which is configured to block the vent channel (8) in the first valve position and to open the vent channel in a second valve position, wherein said handle movement transfers the valve from the first valve position to the second valve position.

2. Freezer according to claim 1, wherein the handle device is configured such that the handle member actuates the breaker element to drive the breaking movement, and the breaking movement is accomplished when the handle member reaches the second handle position.

3. Freezer according to claim 1, wherein the handle device is configured such that the breaking movement is accomplished in the second handle position and a second handle movement is performed after handle movement, which transfers the handle member from the second handle position to a third handle position.

4. Freezer according to claim 1, wherein the freezer has a locking device (5, 6), which can have a locked position, where the door member is closed and locked, and which can have an unlocked position, where the door member is closed and unlocked, wherein, in the first handle position, the valve is in the first valve position and, in the second handle position, the locking device is in the locking position and the valve is in the second valve position.

5. Freezer according to claim 4, wherein, in the first handle position, the locking device has not yet reached the locking position.

6. Freezer according to claim 4, wherein the locking device has a first locking section (6), which is arranged at the handle member, and a second locking section (5), which is arranged at the casing device, wherein the first locking section and the second locking section are configured to fully engage in the locking position.

7. Freezer according to claim 2, wherein, in the third handle position, the locking device is in the locking position and the valve is in the first valve position.

8. Freezer according to claim 3, wherein the handle member has a first part (4*a*) and a second part (4*b*), which are pivotably connected to each other to perform a pivoting movement between a first angle position and a second angle position, wherein, in the first angle position, the handle member is in the second handle position and, in the second angle position, the at least one handle member is in the third handle position.

9. Freezer according to claim 1, wherein the door member has an outer side, which faces away from the inner volume in the closed door position, and an inner side, opposite to the outer side, and a first lateral side and a second lateral side, which are opposite to each other, and a top side and a bottom side, which are opposite to each other, wherein the door member is pivotably attached to the freezer at the first lateral side, and the handle member is pivotably connected at the second lateral side.

10. Freezer according to claim 1, wherein the door member is pivotably connected at the freezer to pivot around the z-axis of a Cartesian coordinate system, wherein the handle member is pivotably connected to the door member to pivot around the x-axis of the Cartesian coordinate system, which x-axis runs through the at least one door member and is perpendicular to the z-axis.

11. Freezer according to claim 10, wherein the handle member has a first part (4*a*) and a second part (4*b*), which are movably arranged to one another, wherein the first part is pivotably connected to the door member (3) to pivot around the x-axis of the Cartesian coordinate system.

12. Freezer according to claim 11, wherein the first part extends parallel to the y-z-plane of the Cartesian coordinate system, wherein the second part has a first section and a second section (4*c*), wherein the first section at least in part extends parallel to the y-z-plane and the second section faces at least in part the door member (3) and at least in part extends parallel to the x-z-plane.

13. Freezer according to claim 1, wherein the handle device has a spring member (4*d*), which is elastically tensioned, when the handle member is moved into the second handle position.

14. Freezer according to claim 1, wherein the breaker element is formed as a pin member, which extends through the vent channel, and which has a first end for breaking the frozen material, wherein, in the second breaker position, the first end is arranged more inside the inner volume than in the first breaker position, and wherein the handle member has a contacting area (12) for contacting a second end of the pin member and for pressing the pin member from the first breaker position into the second breaker position.

15. Freezer according to claim 3, wherein the handle member has a security lock for securing the locked position of the door member, when the door member is locked.

16. Method for fabricating a freezer according to claim 1, wherein the handle member comprises at least a first part and at least a second part, wherein the first part and the second part of the handle member are at least in part composed of a fiber reinforced material.

17. Use of a freezer according to claim 1 for storing laboratory samples, in particular solid, gel-like, and liquid samples, at low temperatures between 0° C. and −50° C. or at ultra low temperatures between −50° C. and −90° C.

* * * * *